US009567052B2

(12) United States Patent
Torrångs et al.

(10) Patent No.: US 9,567,052 B2
(45) Date of Patent: Feb. 14, 2017

(54) STEERING CONTROL SYSTEM FOR A VESSEL AND METHOD FOR OPERATING SUCH A STEERING CONTROL SYSTEM

(75) Inventors: Peter Torrångs, Mölnlycke (SE); Lennart Arvidsson, Kallered (SE); Eva Maria Finn, legal representative, Mölnlycke (SE); Lina Ingrid Finn, legal representative, Mölnlycke (SE); Ebba Maria Finn, legal representative, Mölnlycke (SE)

(73) Assignees: AB VOLVO PENTA, Göteborg (SE); CPAC SYSTEMS AB, Västra Frölunda (SE)

( * ) Notice: Subject to any disclaimer, the term of this patent is extended or adjusted under 35 U.S.C. 154(b) by 957 days.

(21) Appl. No.: 12/439,847

(22) PCT Filed: Sep. 8, 2006

(86) PCT No.: PCT/SE2006/001037

§ 371 (c)(1),
(2), (4) Date: Jul. 12, 2010

(87) PCT Pub. No.: WO2008/030149

PCT Pub. Date: Mar. 13, 2008

(65) Prior Publication Data

US 2011/0028057 A1 Feb. 3, 2011

(51) Int. Cl.
*B63H 25/42* (2006.01)
*B63H 20/12* (2006.01)
(Continued)

(52) U.S. Cl.
CPC ..... *B63H 20/12* (2013.01); *B63H 21/265* (2013.01); *B63H 25/02* (2013.01); *B63H 25/42* (2013.01)

(58) Field of Classification Search
CPC ..... B63H 25/02; B63H 25/42
(Continued)

(56) References Cited

U.S. PATENT DOCUMENTS 7,325,505 B2 * 2/2008 Otobe et al. ..... 114/144 R
7,512,465 B2 * 3/2009 Gai ..... 701/21
(Continued)

FOREIGN PATENT DOCUMENTS

JP 09207889 A 7/1996
JP 2006199189 A * 8/2006
(Continued)

OTHER PUBLICATIONS

International Search Report for corresponding International Application PCT/SE2006/001037.
(Continued)

*Primary Examiner* — Edwin Swinehart
(74) *Attorney, Agent, or Firm* — WRB-IP LLP

(57) ABSTRACT

Steering control system for a vessel including set of propulsion units including at least two propulsion units pivotally arranged in relation to the hull of the vessel for generating a driving thrust of the vessel in a desired direction, the control system including a steering control instrument for generating input signals for control of a desired route of the vessel a control unit complex controlling the angular position of the propulsion units, the control unit complex being arranged for receiving input signals from the steering control instrument, which input signals represents a general direction of movement of the vessel and thus a general desired angular position of each propulsion unit the control unit complex furthermore containing a feed forward pivot angle correction control block for each propulsion unit, which feed forward pivot angle correction blocks are arranged to generate desired angular positions of the pro-
(Continued)

pulsion units by adding a correction value to the general desired angular position of the propulsion units, the correction value including compensation for toe in setting of the propulsion units and/or Ackerman position setting of the propulsion units, and method for operating such a steering control system.

24 Claims, 6 Drawing Sheets

(51) Int. Cl.
*B63H 25/02* (2006.01)
*B63H 20/00* (2006.01)

(58) Field of Classification Search
USPC ..... 114/144 RE, 144 R
See application file for complete search history.

(56) References Cited

U.S. PATENT DOCUMENTS

| | | | | |
|---|---|---|---|---|
| 7,641,525 | B2 * | 1/2010 | Morvillo | 440/42 |
| 2002/0197918 | A1 | 12/2002 | Aarnivuo | |
| 2004/0209731 | A1 | 10/2004 | Graham et al. | |
| 2006/0219146 | A1 * | 10/2006 | Gibbs | B60F 3/0007 114/144 R |

FOREIGN PATENT DOCUMENTS

| | | | |
|---|---|---|---|
| WO | 03093102 | A1 | 11/2003 |
| WO | 2005054050 | A1 | 6/2005 |
| WO | 2006058400 | A1 | 6/2006 |

OTHER PUBLICATIONS

Supplementary European Search Report (Mar. 14, 2014) for corresponding European App. 06784167.6.

* cited by examiner $$\left[\begin{array}{lll} \min\limits_{(dx)} \left[ha-hd\right]^2 & (i) & \\ m_1^2(\alpha_1) & \varepsilon\left[m_{min}^2, m_{max}^2\right] & (ii) \\ m_k^2(\alpha_k) & \varepsilon\left[m_{min}^2, m_{max}^2\right] & (iii) \end{array}\right]$$

FIG. 5

STEERING CONTROL SYSTEM FOR A VESSEL AND METHOD FOR OPERATING SUCH A STEERING CONTROL SYSTEM

BACKGROUND AND SUMMARY

The invention relates to a steering control system for a vessel. In particular the invention relates to a steering control system of a vessel having propulsion units pivotally arranged around an axle which is generally perpendicular to a hull of the vessel, wherein the direction of thrust and thereby the movement of the vessel is controlled by controlling the angular position of the propulsion unit. The invention furthermore relates to the type of propulsion units which are electronically controlled, that is a steering control instrument, for example in the form of a steering wheel or joy sticks, generates input signals to a electronic control unit which in turn controls actuators which turns the propulsion units into a desired position.

Electronically controlled steering systems for vessels are becoming more popular. In electronically controlled steering systems mechanical or hydraulic connections between a steering wheel and the rudder or a pivotally arranged propulsion unit is replaced with an electronic communication channel where input signals from a sensor sensing the position or movement of the steering wheel are transmitted to an electronic control unit controlling actuators which set the position of the rudder or pivotally arranged propulsion unit. An example of an electronically controlled steering system for a vessel is given in WO03/093102. WO03/093102 discloses a steering control system where a steering wheel is coupled to a sensor which senses how far the steering wheel is turned from a starting position. A steering unit receives the input signals from the sensor and generates stored steering angles for the propulsion units. In WO03/093102 the steering unit is arranged to at speed above the hull planing threshold, when running straight ahead, set the underwater housings of the drive units at angle of equal magnitude inclined towards each other, so that the rotational axes of the propellers converge in the forward direction, and to, when turning, the underwater housing closest to the center of the curve is set at a greater steering angle relative to a center plane than the other drive unit. For the purpose of controlling the position of the drive units, the steering unit has stored a fixed value for the toe in position and a fixed ration between the outer and inner drive steering angles for Ackermann steering.

Several problems with known steering systems have been discovered. It has first been noted that vessels are extremely sensitive to the exact position of the propulsion unit when it concerns the roll angle of the vessel and/or lateral forces on the propulsion units. Test have shown that mounting tolerances of a few millimeters may result in that the vessel will obtain an unlevelled roll angle of several degrees when steeling the boat in a straight forward direction. Normally vessel inclination around the length axis of the vessel, that is roll angle position, will be corrected by use of trim planes, which will result in increased fuel consumption or loss of performance. A further problem is known for propulsion units which have a single driving propeller mounted on a propeller axle. This type of propeller generates a reaction force propagating through the propeller axle back up till the engine and the engine mountings. In order to protect the engine mounting from breaking reaction rods may be used. The use of reaction rods has a great impact on the roll angle of the vessel, which is again mitigated by setting of trim planes which will unavoidably result in increased fuel consumption or loss of performance.

Furthermore, the propulsion units are subjected to significant lateral forces from the water flowing by, not only when turning but also when driving straight ahead, where the drive mounting in the hull in particular is subjected to significant stresses, which must be taken into account in the dimensioning thereof. Studies have for example shown, that the waterflow along the bottom of the aft portion of a V-bottomed boat at planing speed is not entirely parallel to the hull bottom. The water flows instead from the center portion of the hull bottom obliquely aft towards the side. Even if the angle is very small, only one or two degrees, the resulting lateral forces on the underwater housing and steering mechanism of the drive units are not negligible.

When turning, the forces on the underwater housing of the drive unit are, of course, larger than when driving straight ahead, especially the forces on the underwater housing of the outer drive unit in relation to the center of the turning curve. On the other hand, the total operating time, during which a boat turns, is relatively small in relation to the time when the boat is moving straight ahead.

A purpose of the present invention is to achieve a method of steering a boat with outboard drive units such that lateral forces having an impact on the propulsion units are controlled. The steering system should for instance ensure that it possible to under straight forward motion of the hull, reduce the forces on the drive units without negatively affecting performance and maneuverability by adding a toe-in or toe-out correction value to a general desired angular position of the propulsion units and to ensure that lateral forces are kept at acceptable levels when turning the vessel, by use of appropriate Ackermann correction values.

It is desirable to provide a steering control system in which the above mentioned problems are solved. According to an aspect of the present invention a steering control system for a vessel includes at least two propulsion units pivotally arranged in relation to the hull of the vessel for generating a driving thrust of said vessel (1) in a desired direction, where the control system includes a steering control instrument for generating input signals for control of a desired route of the vessel a control unit complex controlling the angular position of said propulsion units, said control unit complex being arranged for receiving input signals from said steering control system, which input signals represents a general direction of movement of the vessel and thus a general desired angular position of each propulsion unit said control unit complex furthermore containing a feed forward pivot angle correction control block, which pivot angle correction block is arranged to generate desired angular positions of the propulsion units by adding a correction value to the general desired angular position of the propulsion units. In a preferred embodiment the correction value includes compensation for toe-in or toe-out setting of said propulsion units and/or Ackerman position setting of said propulsion units. That is the steering is performed by to in input signal generated from a steering control instrument, typically a sensor sensing the movement of a steering wheel. The input signal represents a general desired direction of movement. A feed forward pivot angle correction control block is arranged to generate desired angular positions of the propulsion unit by adding a correction value to the general desired angular position of the propulsion units. The pivot angle correction control block is of the feed forward type since it generates desired angular positions of the propulsion units in a feed forward manner by adding correction values to a general desired angular position determined from an input signal generated from a steering control instrument, and which correction values are determined by representations in the form of stored maps or models transforming sensor input signals to a correction value output signal. The correction values typically represent the toe-in or toe-out position and/or the Ackermann position. According to the invention each feed forward pivot angle correction control block is arranged to generate individual correction values for each control unit. Since individual correction angles are generated it is possible to adapt the toe-in or toe-out value for each unit in dependence of the position of the propulsion unit on the hull. It is then possible to set a toe-in or toe-out angle for a specific propulsion unit such that the vessel will not assume an unleveled roll angle when driving in straight forward direction and/or that lateral forces on the propulsion units may deviate form expected values resulting either in excessive wear on the propulsion units or in an increased angular velocity of the propulsion unit when turning, which may result in undesired steering characteristics. That is instead of setting both propulsion units to assume the same toe-in or toe-out angle each propulsion unit is controlled to assume its own unique toe-in or toe-out angle, which may be set for generating a zero roll angle when driving in straight forward direction and/or for generating desired lateral forces on respective propulsion unit. It is furthermore possible to adapt the Ackermann angle to the actual position of the propulsion unit, which is of particular importance when the propulsion units are positioned at different distances from the centerline of the vessel or at different positions along the length axle of the vessel. In the event more than two propulsion units are used or if the propulsion units are asymmetrically positioned with respect to the center line individual setting of Ackermann compensation will be desirable.

In the event any unbalance of the boat exists, such as for example unbalance due to existing reaction rods, or tolerances in the mounting procedure such unbalance can be mitigated by allowing individual correction values for each propulsion unit. In particular it is preferred to set individual toe-in or toe-out compensation values for each propulsion unit for generating a desired roll angle of the vessel or for generating desired levels of the lateral forces when run in forward direction.

Preferably the individual correction values are different for different propulsion units, in particular when the propulsion units are positioned asymmetrically with respect to the center line or in different positions along the length axle of the vessel. Of particular interest is the setting of toe-in or toe-out values and Ackermann values for each propulsion unit. The Ackermann compensation values preferably depend on the position of the propulsion unit in relation to the hull.

The individual correction values for each feed forward pivot angle correction control block are preferably generated by use of in the feed forward pivot angle control block stored maps that for each propulsion unit generates an individual predetermined set correction value dependent on the value of an input signal from a speed control arrangement.

The control unit complex furthermore preferably contains a maximum swing control block, which maximum swing control block is arranged to transform the input signals from said steering control instrument into desired angular positions within an allowed maximum swing range for the propulsion units, wherein the maximum swing control block is arranged to generate individual allowed maximum swing range for each propulsion unit.

Preferably maps stored in the maximum swing control block are used to generate the allowed maximum swing range for each propulsion unit. By use of said maps an individual allowed maximum swing range is set for each propulsion unit, which range is dependent on the value of an input signal from a speed control arrangement.

Generally a common a feed forward pivot angle correction control block can be arranged to determine the individual correction values for each propulsion unit. However it is advantageous to distribute the feed forward pivot angle correction control block into separate control units arranged to each control one propulsion unit. The separate control units receive input signals from a steering control instrument which indicates the desired route of the vessel and locally adapts the pivot angle of the propulsion units by determining the correction values locally. In this embodiment each propulsion unit has its own pivot angle correction control block sub system determining the individual correction values. This idea is generally described in the fourth embodiment disclosed below. It is possible to use the specific features in a central system in a system of having distributed separate control units arranged to each control one propulsion unit.

The invention furthermore relates to a method for operating a steering control system.

BRIEF DESCRIPTION OF DRAWINGS

The invention will be described in further detail below, with references to appended drawings where, FIG. 5 shows an example of a minimization problem formulation which may be used when constructing the feed back loop.

DETAILED DESCRIPTION

Figure 1:
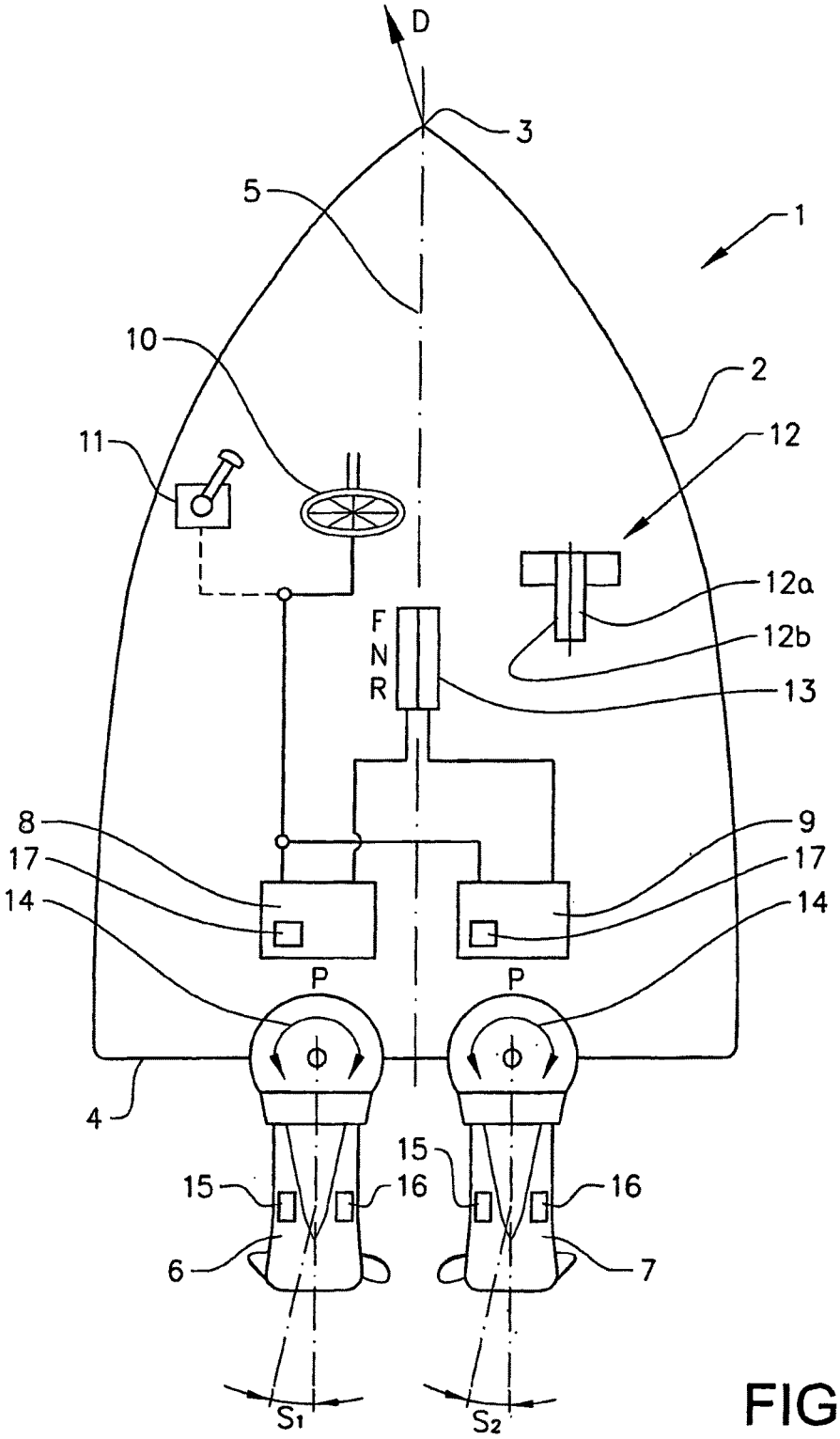
FIG. 1 shows a schematic drawing of a vessel including a steering control system according to the invention

FIG. 1 shows a simplified top view of a vessel 1 in which the present invention can be used. Generally, the invention can be used in any type of vessel, such as larger commercial ships, smaller vessel such as leisure boats and other types of water vehicles or vessels. The invention is particularly useful for small leisure boats, but it is nevertheless not limited to such type of water vehicle only.

As indicated schematically in FIG. 1, the vessel 1 is designed with a hull 2 having a bow 3, a stern 4 and being divided into two symmetrical portions by a center line 5. In the stern 4, two propulsion units 6, 7 are mounted. More precisely, the vessel 1 is provided with a first propulsion unit 6 arranged at the port side and a second propulsion unit 7 arranged at the starboard side. The propulsion units 6, 7, which are pivotally arranged in relation to said hull for generating a driving thrust in a desired direction, are of a generally conventional kind, for example in the form of an outboard drive, an azimuthal drive unit or out board engines. With pivotally arranged is intended herein pivotally arranged for steering purposes, that is the propulsion units are arranged to be pivotable for steering purposes, which generally means that the propulsion units are pivotally arranged around a pivot axle which may be generally transverse to the length and width direction of the vessel. Propulsion units may in some cases also be pivotally arranged around a pivot axle generally extending in the transverse direction for trim purposes. The invention relates to control of the angular position around the pivot axle that controls the steering of the vessel.

The two propulsion units 6, 7 are steerable, by a control unit complex 8,9. The control unit complex preferably includes a separate control unit 8, 9 for each propulsion unit. That is, in the event two propulsion units are used, two control units would be used, in the event three propulsion units are mounted to the vessel, three control units would be used, etc. The control units 8, 9 which are suitably in the form of a computerized unit receive commands from steering control instruments 10, 11. The steering control instruments may be provided in the form of a steering wheel 10 or a joy stick 11 or the combination of both. The separate control units furthermore receive input signals from a throttle lever 12 in a conventional manner. The throttling may be individually controlled by a lever for each propulsion unit or include a lever for each propulsion unit 12*a*, 12*b*. In the event more than two propulsion units are mounted to the vessel, it is generally preferred to have two throttle levers one for each group of propulsion units positioned on the starboard side of the center line and one for the group of propulsion units positioned on the port side of the center line.

The control units 8, 9 furthermore receives input signal from a gear selector 13 which may engage respective propulsion unit in reverse, neutral or drive.

Also here it is generally preferred, in the event more than two propulsion units are mounted to the vessel, to have two gear selectors one for each group of propulsion units positioned on the starboard side of the center line and one for the group of propulsion units positioned on the port side of the center line.

Such gear selector and throttle lever units are previously known as such, and for this reason they are not described in detail here. Based on received information from the steering control instruments 10, 11, the control units 8,9 are arranged to control the first propulsion unit 5 and the second propulsion unit 6 in a suitable manner to propel the vessel 1 with a requested direction and thrust.

The control units thus control steering control actuators 14 for steering the propulsion units to be set into a desired angular position. The control units furthermore controls gear selectors 15 and throttle valves 16 in a conventional manner. The control unit may also contain all other motor control equipment and data which is necessary to run the propulsion units in a desired fashion.

Figure 6:
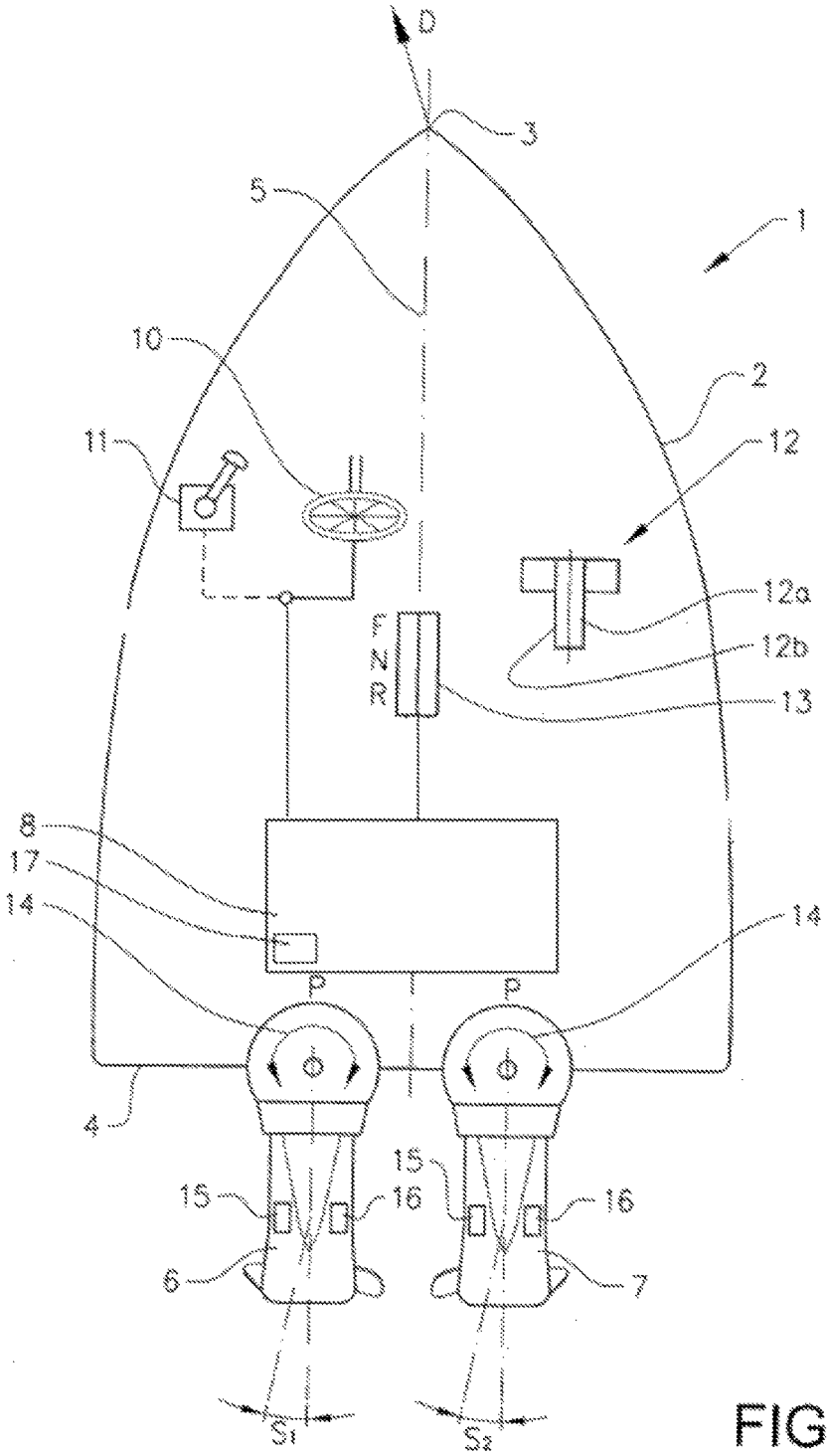
FIG. 6 shows a schematic drawing of a vessel including a steering control system according to another aspect of the invention.

The control units 8,9 furthermore each include a feed forward pivot angle correction control block 17 which may be centrally arranged or distributed such that a control block is arranged for each propulsion unit 6,7. A correction angle control block is shown in more detail in FIG. 2. The feed forward pivot angle correction control block receives input signals a from said steering control instrument (10,11). The input signal $\alpha$ may be generated from a sensor sensing the relative or absolute position of a steering wheel or a joy stick in a conventional manner. In a preferred embodiment the input signal $\alpha$ may vary between ±280°, which correspond to a total swing of the steering wheel 1,5 turns. The input signals a thus in a conventional manner represents a general direction D of movement of the vessel and thus a general desired angular position ($\beta$1, $\beta$2) of each propulsion unit. The general direction of movement D is indicated in FIG. 1 and represents the intended direction of movement as generated by the helmsman controlling the steering wheel. As seen in FIG. 6, instead of having a control block arranged for each propulsion unit, a common feed forward pivot angle correction control block 17 can be arranged to determine the individual correction values for each propulsion unit 6, 7.

The feed forward pivot angle correction control blocks 17 are arranged to generate actual desired angular positions of the propulsion units (s1, s2) by adding a correction value (v1, v2) to the general desired angular position ($\beta$1, $\beta$2) of the propulsion units, said correction value (v1, v2) including compensation for toe-in or toe-out setting ($\theta$1, $\theta$2) of said propulsion units and/or Ackerman position setting (A1, A2) of said propulsion units. Here the general desired angular position ($\beta$1, $\beta$2) represents the position the propulsion unit would take, in the event the correction value, is set to zero, while the actual desired angular position represents the general desired angular positions plus the correction value, that is ($si=\beta i+vi$) for propulsion unit number i.

Figure 2:
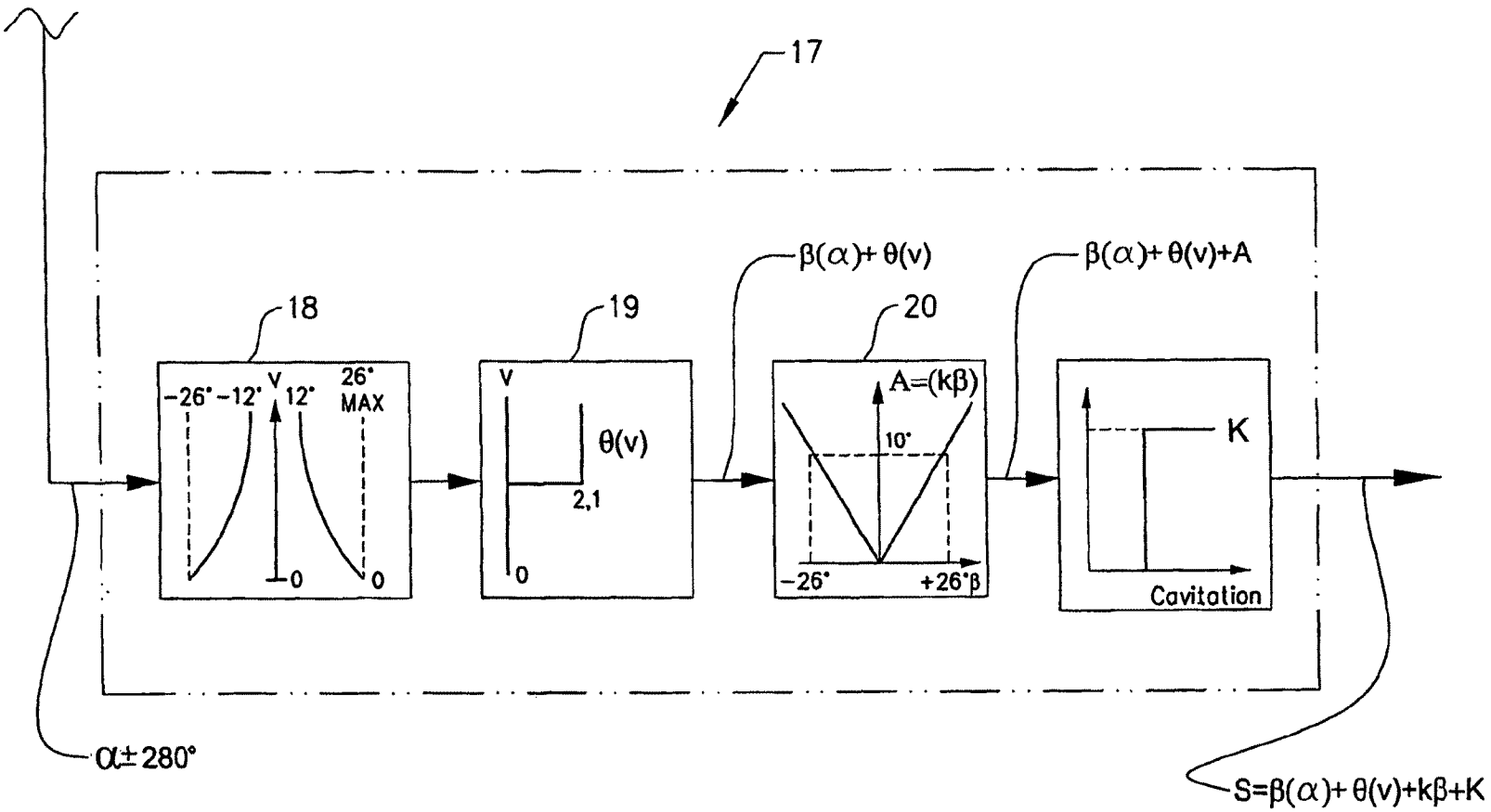
FIG. 2 shows an example of a feed forward pivot angle correction control block included in a control unit.

The feed forward pivot angle correction control block in the embodiment shown in FIG. 2 includes four functional blocks, a first functional block 18, a second functional block 19, a third functional block 20 and a fourth functional block 21. The first functional block is in the embodiment shown in FIG. 2 a maximum swing control block. The maximum swing control block 18 is arranged to transform the input signal $\alpha$ from said steering control instrument (10,11) into a general desired angular position $\beta$ within an allowed maximum swing range for the propulsion unit associated with the control unit. In a typical embodiment the maximum swing control block 18 contains a map that transforms the input signal $\alpha$ varying from ±280°, to an output signal representing the general desired angular position $\beta$ of the propulsion unit, which output signal varies between ±26° at low or zero speed and ±10° at high or over planning speeds.

The second functional block 19 is in the embodiment shown in FIG. 2 a toe-in or toe-out correction control block. The toe-in or toe-out correction control block 18 adds a toe in value $\theta$ to the general desired angular position $\beta$. The toe in value $\theta$ may depend on the velocity of the vessel and of the position of the propulsion unit on the vessel. Typical values for toe in setting is that a toe in correction of about 1-2° in the direction toward the center line is added to the general desired angular position when the vessels is propelled above planning speeds. Negative values of toe in may represent a toe-out position, rather than having two independent variables.

The third functional block 20 is in the embodiment shown in FIG. 2 an Ackerman correction control block. The Ackermann correction control block 20 adds an Ackermann value A to the general desired angular position $\beta$. The Ackerman value depends on the general desired angular position $\beta$ of the propulsion unit and of the position of the propulsion unit on the hull of the vessel. Typical values for Ackerman setting is that an Ackermann correction of about 10° is added in the event the general desired angular position has a value of 26°. The Ackermann value may preferably vary linearly in relation to t general desired angular position.

The fourth functional control block 21 is a cavitation avoidance control block. Cavitation is an effect where aeration (bubbling) and boiling of water caused by creation of a low pressure area occurs. Generally this may be caused by a solid shape (propeller blade) passing through the water, in such a position and speed, that a low pressure area is formed due to the inability to move through the water in nonresistant manner. An example is, a propeller blade that has a rough edge would not cut efficiently through the water, thus creating a low pressure area. If the pressure drops below the vapor pressure, a cavitation bubble will form in that region. These bubbles will collapse when they reach the higher pressure region of the blade. This causes a rapid change in pressure and can result in physical erosion. You may notice burns (erosion) at some area on the face of the blade. In order to avoid cavitation the angular position of propulsion units may be corrected such that the propulsion units are directed more toward the center line of the hull of the vessel. Alternatively the thrust delivered by the propulsion unit cavitation may be reduced. The cavitation detection means may be provided in the form of a sensor sensing the rotational velocity of a driving axle in the propulsion unit. This is possible since cavitation result in increased rotational velocity of the driving axle since cavitation will lead to a reduced resistance of rotating a propeller in water, since the water ambient to the propeller will contain a gas mixture.

The feed forward pivot angle correction control blocks 17 are thus arranged to generate actual desired angular positions of the propulsion units (s1, s2), which may be expressed as follows: $s=\beta(a)+\theta(v)+k\beta$; where $\beta$ is the general desired angular position, $\theta$ is the toe in correction dependent of the velocity of the vessel (which may be given by data from GPS sensors, logs or implicitly be requested or delivered thrust by the propulsion units) and $k\beta$ is the Ackermann correction value A expressed as a linear function of the general desired angular position $\beta$. In the event a cavitation control block is used a cavitation correction term K may be added to generate actual desired angular positions of the propulsion units (s1, s2), The cavitation correction term K may be a constant correction angle, which has opposite signs depending on the position of the propulsion unit in relation to the center line. The cavitation correction term K may also be dependent on the location of the propulsion unit concerned. It is furthermore possible to continuously increase the cavitation correction term K until the detected cavitation ceases. Since caviation may be avoided by reduction on the thrust leved generated by the propulsion unit concerned, it is possible to combine the addition of a cavitation correction term K to the general desired angular position with a reduction of the thrust level.

The actual desired angular positions s1, s2 are shown in FIG. 1.

According to the invention each feed forward pivot angle correction control block is arranged to generate individual correction values for each propulsion unit. This means that each feed forward pivot angle correction control block 17 has been individually programmed to generate individual correction values which are suitable to the position on the hull of the vessel of the propulsion unit associated with the feed forward pivot angle correction control block. Furthermore individual correction values may be set to generate a desired trim angle or to take up tolerances in the mounting of the propulsion units or furthermore to reduce the roll angle from an unleveled position generated by use of reaction rods as explained above. The correction values are thus individual in the sense that different propulsion units mounted in different positions with respect to an axis of symmetry of the hull assumes different correction values. In the event roll angle correction should be performed the correction values are individual in the sense that different propulsion units mounted in the same positions with respect to an axis of symmetry of the hull assumes different correction values. The existence of individual values can be symbolically expressed as $Vj \neq Vj$ for at least one pair (i,j) of propulsion units under a certain operating condition.

The invention thus contemplates two embodiments of the invention. A first embodiment is contemplated where different propulsion units mounted in different positions with respect to an axis of symmetry of the hull assumes different correction values. This means that propulsion units not being symmetrically positioned will have different correction values. The propulsion units may be positioned on different positions relating to the centerline or length axis of the hull.

A second embodiment is contemplated where different propulsion units mounted in the same positions with respect to an axis of symmetry of the hull assumes different correction values in order to generate a desired roll angle. The roll angle correction and or correction term for lateral forces may be needed to compensate for different load on the starboard and port side of the vessel, to compensate for different thrust provided from symmetrically positioned propulsion units, to compensate for reaction rods stabilising the prolusion units or for any other attached equipment that may generate un unleveled roll angle.

The two embodiments may be combined. In particular, correction due to mounting tolerances may be judged to belong to both categories.

For the purpose of Ackermann correction it is contemplated to generate individual Ackermann correction values for propulsion units in the sense that different propulsion units mounted in different positions with respect to an axis of symmetry of the hull assumes different Ackermann values. This means that propulsion units not being symmetrically positioned will have different Ackermann values. The propulsion units may be positioned on different positions relating to the centerline or length axis of the hull.

The inventive idea may according to a preferred embodiment be expressed as that at least one feed forward pivot angle correction control block is arranged to generate a correction value for at least propulsion unit, which is different from the correction values generated in the remaining feed forward pivot angle correction control blocks.

The preferred embodiments of the invention thus generally relate to the three following embodiments:

Embodiment 1

A steering control system (7) for a vessel (1) including at least two propulsion units (5,6) pivotally arranged in relation to the hull (2) of the vessel (1) for generating a driving thrust of said vessel (1) in a desired direction, said control system including a steering control instrument (10,11) for generating input signals for control of a desired route of the vessel a control unit complex (8,9) controlling the angular position of said propulsion units (5,6), said control unit complex being arranged for receiving input signals from said steering control instrument (10,11), which input signals represents a general direction of movement of the vessel and thus a general desired angular position of each propulsion unit said control unit complex furthermore containing a feed forward pivot angle correction control block for each propulsion unit, which feed forward pivot angle correction blocks are arranged to generate actual desired angular positions of the propulsion units by adding a correction value to the general desired angular position of the propulsion units, said correction value including compensation for toe-in or toe-out setting of said propulsion units and/or Ackerman position setting of said propulsion units, wherein different propulsion units mounted in different positions with respect to an axis of symmetry of the hull assumes different correction values.

Method of operating a steering control system (7) for a vessel (1) including at least two propulsion units (5,6) pivotally arranged in relation to the hull (2) of the vessel (1) for generating a driving thrust of said vessel (1) in a desired direction, said control system including a steering control instrument (10,11) generating input signals for control of a desired route of the vessel a control unit complex (8,9) controlling the angular position of said propulsion units (5,6), said control unit complex receiving input signals from said steering control system, which input signals represents a general direction of movement of the vessel and thus a general desired angular position of each propulsion unit said control unit complex furthermore containing a feed forward pivot angle correction control block for each propulsion unit, which feed forward pivot angle correction blocks generate actual desired angular positions of the propulsion units by adding a correction value to the general desired angular position of the propulsion units, said correction value including compensation for toe-in or toe-out setting of said propulsion units and/or Ackerman position setting of said propulsion units, wherein different propulsion units mounted in different positions with respect to an axis of symmetry of the hull assumes different correction values.

Embodiment 2

A steering control system (7) for a vessel (1) including at least two propulsion units (5,6) pivotally arranged in relation to the hull (2) of the vessel (1) for generating a driving thrust of said vessel (1) in a desired direction, said control system including a steering control instrument (10,11) for generating input signals for control of a desired route of the vessel a control unit complex (8,9) controlling the angular position of said propulsion units (5,6), said control unit complex being arranged for receiving input signals from said steering control instrument (10,11), which input signals represents a general direction of movement of the vessel and thus a general desired angular position of each propulsion unit said control unit complex furthermore containing a feed forward pivot angle correction control block for each propulsion unit, which feed forward pivot angle correction blocks are arranged to generate actual desired angular positions of the propulsion units by adding a correction value to the general desired angular position of the propulsion units, said correction value including compensation for toe-in or toe-out setting of said propulsion units and/or Ackerman position setting of said propulsion units, wherein different propulsion units mounted in the same positions with respect to an axis of symmetry of the hull assumes different correction values in order to generate a desired roll angle and or a desired level of lateral forces on the propulsion units.

Method of operating a steering control system (7) for a vessel (1) including at least two propulsion units (5,6) pivotally arranged in relation to the hull (2) of the vessel (1) for generating a driving thrust of said vessel (1) in a desired direction, said control system including a steering control instrument (10,11) generating input signals for control of a desired route of the vessel a control unit complex (8,9) controlling the angular position of said propulsion units (5,6), said control unit complex receiving input signals from said steering control system, which input signals represents a general direction of movement of the vessel and thus a general desired angular position of each propulsion unit said control unit complex furthermore containing a feed forward pivot angle correction control block for each propulsion unit, which feed forward pivot angle correction blocks generate actual desired angular positions of the propulsion units by adding a correction value to the general desired angular position of the propulsion units, said correction value including compensation for toe-in or toe-out setting of said propulsion units and/or Ackerman position setting of said propulsion units, wherein different propulsion units mounted in the same positions with respect to an axis of symmetry of the hull assumes different correction values in order to generate a desired roll angle and or a desired level of lateral forces on the propulsion units.

Embodiment 3

A steering control system (7) for a vessel (1) including at least two propulsion units (5,6) pivotally arranged in relation to the hull (2) of the vessel (1) for generating a driving thrust of said vessel (1) in a desired direction, said control system including a steering control instrument (10,11) for generating input signals for control of a desired route of the vessel a control unit complex (8,9) controlling the angular position of said propulsion units (5,6), said control unit complex being arranged for receiving input signals from said steering control instrument (10,11), which input signals represents a general direction of movement of the vessel and thus a general desired angular position of each propulsion unit said control unit complex furthermore containing a feed forward pivot angle correction control block for each propulsion unit, which feed forward pivot angle correction blocks are arranged to generate actual desired angular positions of the propulsion units by adding a correction value to the general desired angular position of the propulsion units, said correction value including compensation for toe-in or toe-out setting of said propulsion units and/or Ackerman position setting of said propulsion units, wherein different propulsion units mounted in different positions with respect to an axis of symmetry of the hull assumes different Ackermann values.

Method of operating a steering control system (7) for a vessel (1) including at least two propulsion units (5,6) pivotally arranged in relation to the hull (2) of the vessel (1) for generating a driving thrust of said vessel (1) in a desired direction, said control system including a steering control instrument (10,11) generating input signals for control of a desired route of the vessel a control unit complex (8,9) controlling the angular position of said propulsion units (5,6), said control unit complex receiving input signals from said steering control system, which input signals represents a general direction of movement of the vessel and thus a general desired angular position of each propulsion unit said control unit complex furthermore containing a feed forward pivot angle correction control block for each propulsion unit, which feed forward pivot angle correction blocks generate actual desired angular positions of the propulsion units by adding a correction value to the general desired angular position of the propulsion units, said correction value including compensation for toe-in or toe-out setting of said propulsion units and/or Ackerman position setting of said propulsion units, different propulsion units mounted in different positions with respect to an axis of symmetry of the hull assumes different Ackermann values.

For the sake of clarity it is denoted that toe in values or Ackermann values for two propulsion units that are symmetrically positioned with respect to the center line and which are the mirror images of each other are not to be seen as individual or different, that is a toe in value of +G° and of −G0 with respect to a center line are not to be deemed as being individual or different. More precisely, in order to be different it is required that the absolute value of the correction value should be different or more precisely that the correction value for a symmetric pair of should be asymmetric with respect to the center line of the hull. In order to be individual it is required that at least an asymmetric pair of propulsion units are mounted that assumes different correction values or that a symmetric pair with different correction values are mounted. In the event roll angle correction or correction in respect of lateral forces on the propulsion units are not performed it is required that at least one asymmetric pair exists.

Embodiment 4

A steering control system (7) for a vessel (1) including at least two propulsion units (5,6) pivotally arranged in relation to the hull (2) of the vessel (1) for generating a driving thrust of said vessel (1) in a desired direction, said control system including a steering control instrument (10,11) for generating input signals for control of a desired route of the vessel a control unit complex (8,9) controlling the angular position of said propulsion units (5,6), said control unit complex being arranged for receiving input signals from said steering control instrument (10,11), which input signals represents a general direction of movement of the vessel and thus a general desired angular position of each propulsion unit said control unit complex furthermore containing a pivot angle correction control block for each propulsion unit, which pivot angle correction blocks are arranged to generate actual desired angular positions of the propulsion units by adding a correction value to the general desired angular position of the propulsion units.

Method of operating a steering control system (7) for a vessel (1) including at least two propulsion units (5,6) pivotally arranged in relation to the hull (2) of the vessel (1) for generating a driving thrust of said vessel (1) in a desired direction, said control system including a steering control instrument (10,11) generating input signals for control of a desired route of the vessel a control unit complex (8,9) controlling the angular position of said propulsion units (5,6), said control unit complex receiving input signals from said steering control system, which input signals represents a general direction of movement of the vessel and thus a general desired angular position of each propulsion unit said control unit complex furthermore containing a pivot angle correction control block for each propulsion unit, which pivot angle correction blocks generate actual desired angular positions of the propulsion units by adding a correction value to the general desired angular position of the propulsion units. The idea of having a plurality of pivot angle control blocks may be applied to embodiments 1-3 and to steering control systems and methods for operating a steering control systems as disclosed herein.

Figure 3C:
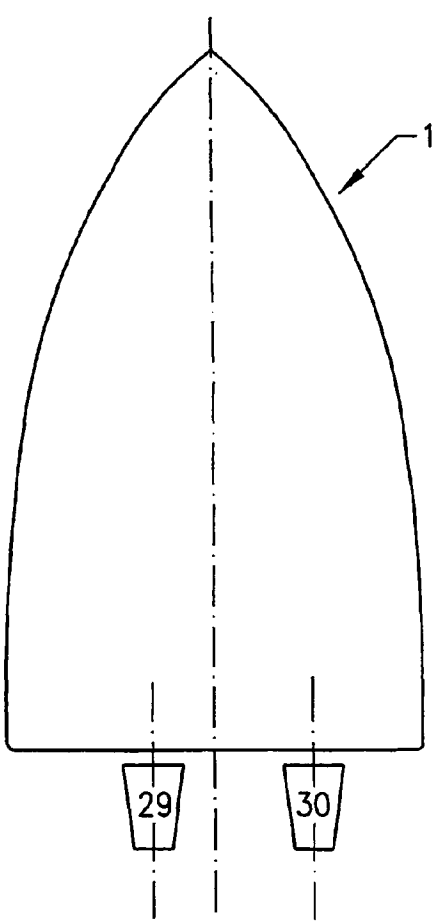
FIGS. 3*a*-3*c* shows three different examples of vessels including propulsion units being controlled by control units having individual correction values.
Figure 3B:
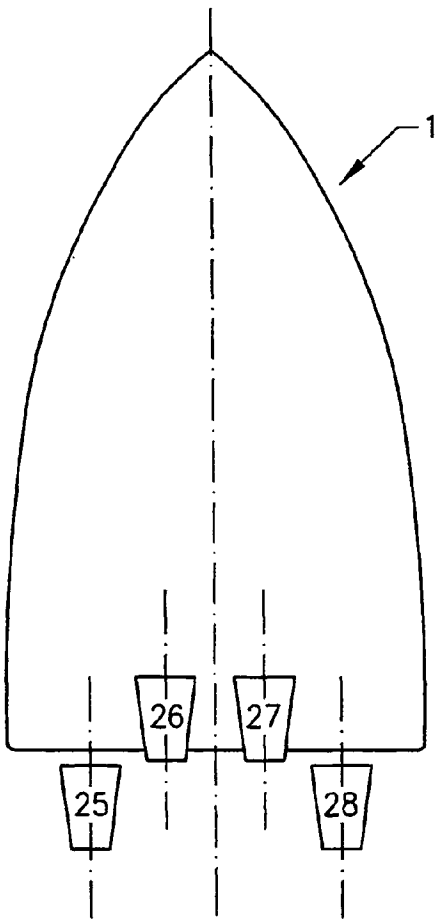
Figure 3A:
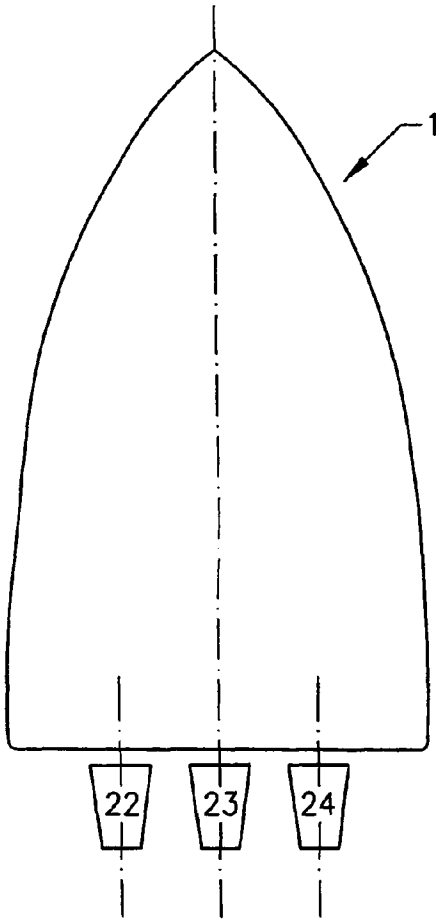

In FIG. 3*a* is shown a vessel 1 including three propulsion units 22-24, a starboard, a center and a port respectively. The starboard and the port may have identical correction values, while the port has its own different correction value. In the event roll angle correction should take place also the starboard and port propulsion units may have different correction values. In FIG. 3*b* a vessel 1 having four different propulsion units 25-28 arranged in an upper symmetrically positioned pair 26, 27 and a lower symmetrically positioned pair 25, 28. Each pair may have identical correction values while the upper and lower pair has correction values stored which are different from each other. In FIG. 3*c* a vessel 1 having two asymmetrically arranged propulsion units 29 30 is shown. Due to the asymmetric arrangement each propulsion units is controlled to assume different correction values. Embodiments, such as the examples in FIGS. 3*a*-3*c*, having 3-5 propulsion units are particularly preferred.

Figure 4:
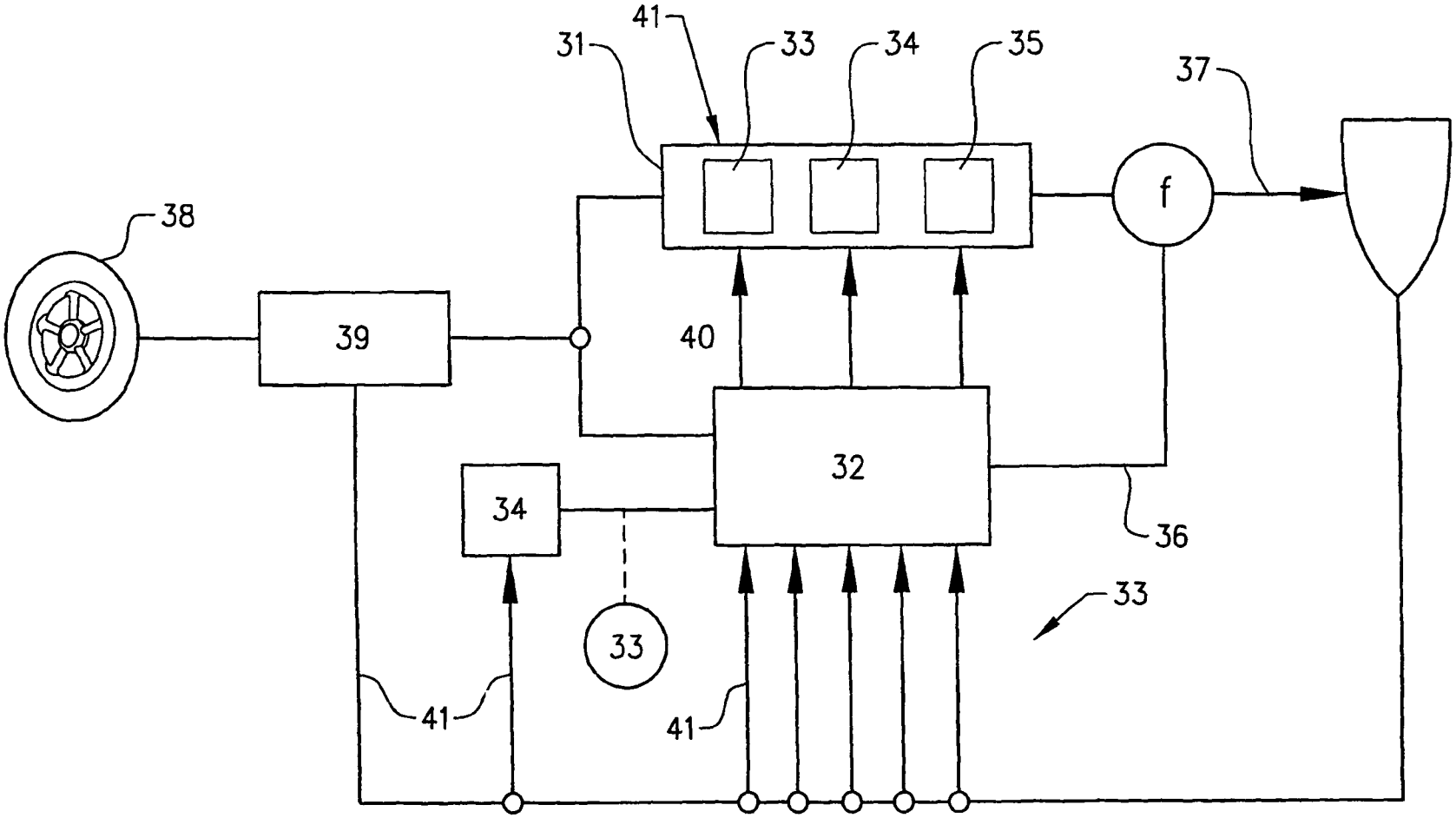
FIG. 4 shows a steering control system including a feed forward pivot angle control block, which is supplemented by a feed back control loop for updating respective functional control blocks in the feed forward pivot angle control blocks.

In FIG. 4 a steering control system including a feed forward pivot angle control block 31 which is supplemented by a feed back control loop 32 for updating respective functional control blocks 33-35 in the feed forward pivot angle control block 31. The functional control blocks 33-35 in the feed forward pivot angle control block may advantageously include at least an Ackermann control block 33 and a toe-in or toe-out control block 34. A further cavitation control block 35 may optionally be included. The feed back control loop 32 may be provided in the form of a recursive routine which minimizes the difference between an actual trajectory of the vessel and a requested trajectory of the vessel with respect of pivot angle correction terms (v1, v2) for each propulsion unit under a set of boundary conditions. The boundary conditions B may include requirements on fuel consumption, limitations in roll and/or pitch angle of the vessel, available torque for performing pivoting motion for steering the propulsion units, maximum allowable torque on the propulsion units from lateral water forces acting on the propulsion units, available current or energy resources for servo motors performing turning operation of propulsion units for steering purposes, input data from cavitation detection means, vessel speed data or the like. The actual trajectory may be decided from input signals from sensor means in the form of for instance a compass 33 or a gps sensor. It is furthermore possible to in a block 34 functional block 34 estimate the actual trajectory from a model calculating the actual trajectory from input data representing actual pivot angle position of the propulsion units and input data representing the thrust generated by the propulsion units. The recursive routine receives input signals 35 from an appropriate set of sensor signals or estimates of variables such as estimated vessel speed or propulsion unit rpms, fuel consumption, cavitation detection etc. The feed back control loop 32 generates an output correction term 36 updating the correction values provided from the feed forward pivot angle control block 31. A set of requested angular positions for the propulsion units are generated as an output signal 37 from the system. The system in FIG. 4 furthermore includes a steering control instrument 38 for generating input signals for control of a desired route of the vessel and a control block 39 which transforms the input signal from the steering control system into a general desired angular position of each propulsion unit.

The feed back control loop may preferably updates maps or models M stored in the feed forward correction control blocks such that the feed forward model may be improved. Updated parameter values 40 are provided from the feed back control loop 32 to the feed back control loop. The functional blocks 31, 32, 34, 38 may all receive appropriate sensor input signals 41 in addition to the signals referred to above, such as for instance input signals representing vessel speed, delivered thrust from the propulsion units or propulsion unit rpms.

An example of a minimization problem formulation which may be used when constructing the feed back loop is shown in FIG. 5. The problem is stated as minimising the difference between the time derivate or the differentiation with respect of time of the actual direction ha of the vessel and the time derivate or the differentiation with respect of time of the desired direction lid of the vessel. The minimization may be performed under a weight function w which may consider that deviation at certain angles, such at the angular end positions of the propulsion units should be given less weight or that deviation at certain speeds such a low speed should be given less weight. The minimization is furthermore performed under a set of boundary conditions ii. The boundary conditions can reflect available torque for turning respective propulsion unit around its pivot axle for steering, available current for step motors performing the turning movement, available total energy for performing the steering etc.

The invention claimed is:

1. Steering control system for a vessel including a set of propulsion units including at least two propulsion units pivotally arranged in relation to a hull of the vessel for generating a driving thrust of the vessel in a desired direction, the control system including a steering control instrument for generating input signals for control of a desired route of the vessel, and a control unit complex controlling angular positions of the propulsion units, the control unit complex being arranged for receiving input signals from the steering control instrument, which input signals represent a desired general direction of movement of the vessel and a general desired angular position of each propulsion unit, the control unit complex containing a plurality of feed forward pivot angle correction control blocks, each feed forward pivot angle correction control block corresponding to a respective corresponding propulsion unit of the propulsion units, each feed forward pivot angle correction control block being individually programmed for the corresponding propulsion unit to generate actual desired individual angular positions of the propulsion units by adding an individual correction value to the general desired angular position of the corresponding propulsion unit, wherein each individual correction value for each corresponding propulsion unit is determined to compensate for two propulsion units of the propulsion units not being symmetrically positioned on either side of an axis of symmetry of the vessel, the two propulsion units being disposed on opposite sides of the axis of symmetry of the vessel and both being one of closest to or furthest from the axis of symmetry of the vessel of all propulsion units on the vessel.

2. Steering control system according to claim 1, wherein the correction value includes compensation for toe-in or toe-out setting of the propulsion units and/or Ackerman position setting of the propulsion units.

3. Steering control system according to claim 1, wherein each feed forward pivot angle correction control block is arranged to generate correction values for its respective propulsion unit of the at least two propulsion units which are different from correction values generated for at least one other propulsion unit of the propulsion units.

4. Steering control system according to claim 2, wherein each feed forward pivot angle correction control block is arranged to generate a toe in compensation value for its respective propulsion unit of the at least two propulsion units which is different from toe in compensation values generated for at least one other propulsion unit of the propulsion units.

5. Steering control system according to claim 2, wherein each feed forward pivot angle correction control block is arranged to generate an Ackermann compensation value for its respective propulsion unit of the at least two propulsion units which is different from Ackermann compensation values generated for at least one other propulsion unit of the propulsion units.

6. Steering control system according to claim 5, wherein the Ackermann compensation values depend on the position of the at least two propulsion units in relation to the hull.

7. Steering control system according to claim 4, wherein the feed forward pivot angle correction control block is arranged to generate different toe in compensation values for different ones of the at least two propulsion units for generating a desired roll angle of the vessel when the vessel is run in a forward direction.

8. Steering control system according to claim 1, wherein the individual correction values for each propulsion unit are arranged to be generated by use of maps stored in its respective feed forward pivot angle correction control block, the feed forward pivot angle correction control block being arranged to generate, for its respective propulsion unit, an individual predetermined correction value dependent on a value of an input signal from a speed control arrangement.

9. Steering control system according to claim 1, wherein the control unit complex contains a maximum swing control block arranged to transform the input signals from the steering control instrument into general desired angular positions within an allowed maximum swing range for the propulsion units, wherein the maximum swing control block is arranged to generate individual allowed maximum swing ranges for each propulsion unit.

10. Steering control system according to claim 8, wherein the allowed maximum swing range for each propulsion unit is arranged to be generated by use of maps stored in the maximum swing control block, the maximum swing control block being arranged to generate, for each propulsion unit, an individual predetermined set allowed maximum swing range dependent on a value of an input signal from a speed control arrangement.

11. Steering control system according to claim 1, wherein a feed back control loop updates maps or models stored in the feed forward pivot angle correction control block.

12. Steering control system for a vessel including a set of propulsion units including at least two propulsion units pivotally arranged in relation to a hull of the vessel for generating a driving thrust of the vessel in a desired direction, the control system including a steering control instrument for generating input signals for control of a desired route of the vessel, and a control unit complex controlling angular positions of the propulsion units, the control unit complex being arranged for receiving input signals from the steering control instrument, which input signals represent a desired general direction of movement of the vessel and a general desired angular position of each propulsion unit, the control unit complex containing a feed forward pivot angle correction control block arranged to generate actual desired angular positions of the propulsion units by adding an individual correction value to the general desired angular position of the corresponding propulsion unit, wherein the feed forward pivot angle correction control block is arranged to generate individual correction values for each corresponding propulsion unit included in the set of propulsion units, wherein each individual correction value for each corresponding propulsion unit is determined to compensate for two propulsion units of the propulsion units not being symmetrically positioned on either side of an axis of symmetry of the vessel, the two propulsion units being disposed on opposite sides of the axis of symmetry of the vessel and both being one of closest to or furthest from the axis of symmetry of the vessel of all propulsion units on the vessel, and wherein the control unit complex contains a feed back control loop which minimizes the difference between an actual trajectory of the vessel and a requested trajectory of the vessel with respect to individually variable pivot angle correction terms for each propulsion unit under a set of boundary conditions.

13. Method of operating a steering control system for a vessel including at least two propulsion units pivotally arranged in relation to a hull of the vessel for generating a driving thrust of the vessel in a desired direction, comprising generating input signals for control of a desired route of the vessel via a steering control instrument of the control system, and controlling angular positions of the propulsion units using a control unit complex, the control unit complex receiving input signals from the steering control instrument, which input signals represent a desired general direction of movement of the vessel and a general desired angular position of each propulsion unit, the control unit complex furthermore containing a plurality of feed forward pivot angle correction control blocks, a feed forward pivot angle correction control block corresponding to a respective corresponding propulsion unit of the propulsion units, each feed forward pivot angle correction control block being individually programmed for the corresponding propulsion unit and generating actual desired individual angular positions of its corresponding propulsion unit by adding an individual correction value to the general desired angular position of the corresponding propulsion unit, wherein each individual correction value for each corresponding propulsion unit is determined to compensate for two propulsion units of the propulsion units not being symmetrically positioned on either side of an axis of symmetry of the vessel, the two propulsion units being disposed on opposite sides of the axis of symmetry of the vessel and both being one of closest to or furthest from the axis of symmetry of the vessel of all propulsion units on the vessel.

14. Method of operating a steering control system according to claim 13, wherein the correction value includes compensation for a toe in setting of the propulsion units and/or an Ackerman position setting of the propulsion units.

15. Method of operating a steering control system according to claim 13, wherein each feed forward pivot angle correction control block generates correction values for its respective propulsion unit which are different than the correction values generated for other ones of the propulsion units.

16. Method of operating a steering control system according to claim 15, wherein each feed forward pivot angle correction control block generates a toe in compensation value for its respective propulsion unit which is different from the toe in compensation value generated for the other ones of the propulsion units.

17. Method of operating a steering control system according to claim 15, wherein each feed forward pivot angle correction control block generates an Ackermann compensation value for its respective propulsion unit, wherein an Ackerman compensation value generated for at least one propulsion unit is different from an Ackermann compensation value generated for other ones of the propulsion units.

18. Method of operating a steering control system according to claim 17, wherein the Ackermann compensation values depend on a position of the at least one propulsion unit in relation to the hull.

19. Method of operating a steering control system according to claim 16, comprising generating different toe in compensation values for different ones of the at least two propulsion units for generating a desired roll angle of the vessel when the vessel is run in a forward direction.

20. Method of operating a steering control system according to claim 13, wherein the individual correction values for each feed forward pivot angle correction control block are generated by use of, by the feed forward pivot angle control block, stored maps, the feed forward pivot angle control block generating, for its respective propulsion unit, an individual predetermined set correction value dependent on a value of an input signal from a speed control arrangement.

21. Method of operating a steering control system according to claim 13, wherein the control unit complex furthermore containing a maximum swing control block, which maximum swing control block transform the input signals from the steering control instrument into desired angular positions within an allowed maximum swing range for the propulsion units, wherein the maximum swing control block generates an individual allowed maximum swing range for each propulsion unit.

22. Method of operating a steering control system according to claim 21, wherein the allowed maximum swing range for the maximum swing control block is generated by use of, in the maximum swing control block, stored maps, the maximum swing control block generating, for each propulsion unit, an individual predetermined set allowed maximum swing range dependent on a value of an input signal from a speed control arrangement.

23. Method of operating a steering control system for a vessel including at least two propulsion units pivotally arranged in relation to a hull of the vessel for generating a driving thrust of the vessel in a desired direction, comprising generating input signals for control of a desired route of the vessel via a steering control instrument of the control system, and controlling angular positions of the propulsion units using a control unit complex, the control unit complex receiving input signals from the steering control instrument, which input signals represent a desired general direction of movement of the vessel and a general desired angular position of each propulsion unit, the control unit complex furthermore containing a feed forward pivot angle correction control block, the feed forward pivot angle correction block generating actual desired angular positions of the propulsion units by adding an individual correction value to the general desired angular position of a corresponding propulsion unit of the set of propulsion units, wherein the feed forward pivot angle correction control block generates individual correction values for each corresponding propulsion unit in the set of propulsion units, wherein each individual correction value for each corresponding propulsion unit is determined to compensate for two propulsion units of the set of propulsion units not being symmetrically positioned on either side of an axis of symmetry of the vessel, the two propulsion units being disposed on opposite sides of the axis of symmetry of the vessel and both being one of closest to or furthest from the axis of symmetry of the vessel of all propulsion units on the vessel, wherein the control unit complex contains a feed back control loop which minimizes the difference between an actual trajectory of the vessel and a requested trajectory of the vessel with respect to individually variable pivot angle correction terms for each propulsion unit under a set of boundary conditions.

24. Method of operating a steering control system according to claim 23, wherein a feed back control loop updates maps or models stored in the feed forward correction control block.

* * * * *